US005126788A

United States Patent [19]

Koga

[11] Patent Number: 5,126,788

[45] Date of Patent: Jun. 30, 1992

[54] CLAMSHELL TYPE PRINT DEVICE WITH OPTICAL UNIT STABILIZATION

[75] Inventor: Yuji Koga, Nagoya, Japan

[73] Assignee: Brother Kogyo Kabushiki Kaisha, Nagoya, Japan

[21] Appl. No.: 723,338

[22] Filed: Jun. 28, 1991

[30] Foreign Application Priority Data

Aug. 23, 1990 [JP] Japan ..... 2-223640

[51] Int. Cl.[5] ..... G03G 15/00; G03G 21/00

[52] U.S. Cl. ..... 355/200; 355/229; 355/235; 355/236

[58] Field of Search ..... 355/210, 211, 200, 235, 355/236, 232, 233, 228, 229, 202; 358/296, 300; 312/294, 295, 298, 319, 320, 322, 325

[56] References Cited

U.S. PATENT DOCUMENTS

| | | | |
|---|---|---|---|
| 4,557,586 | 12/1985 | Hayashi et al. | 355/202 X |
| 4,609,277 | 9/1986 | Yokoyama et al. | 355/210 X |
| 4,760,424 | 7/1988 | Ohba et al. | 355/245 |
| 4,876,572 | 10/1989 | Nagatsuna | 355/210 |
| 4,908,659 | 3/1990 | Ishii et al. | 355/200 |
| 4,947,208 | 8/1990 | Komatso et al. | 355/200 |
| 5,005,053 | 4/1991 | Kozuka | 355/200 X |

*Primary Examiner*—A. T. Grimley
*Assistant Examiner*—Matthew S. Smith
*Attorney, Agent, or Firm*—Oliff & Berridge

[57] ABSTRACT

A print device for printing a image on a printing medium by transferring the image formed on a photosensitive member to the printing medium, having an accommodation case which consists of an upper case and a lower case, the upper case rotatable between an open and a closed position with respect to the lower case; a light scanning device installed in the accommodation case separately with the upper case and for scanning the photosensitive member with a light; a first urging member for applying a force to move the upper case toward the open position; a keeping member for holding the upper case in the closed position against the applying force of the first urging member; a release member for releasing the keeping member; a moving member for moving the light scanning device toward the open position when the upper case is opened; a support member disposed in the lower case for supporting the light scanning device when the upper case is closed; and a second urging member in the upper case for urging the light scanning device toward the support member.

17 Claims, 3 Drawing Sheets

CLAMSHELL TYPE PRINT DEVICE WITH OPTICAL UNIT STABILIZATION

BACKGROUND OF THE INVENTION

1. Field of the Invention

The present invention relates to a print device with a light scanning device.

2. Description of Related Art

Conventionally, in print devices of this type, a sheet feeding route divides a print device body into an upper case and a lower case in order not to cause a paper jam. There are many kinds of print devices wherein the upper case is pivotally connected with one end of the lower case to permit opening of the upper case. Moreover, in order to show the above mentioned sheet feeding route when the upper part of the lower case is opened, these print devices mount a light scanning device for emitting a laser beam and a process cartridge, containing a photosensitive body for forming an image and a developing device, in the upper case. As a result, the upper case is so heavy it is not easy to rotate the upper case to an open position in order to observe the upper part of the lower case. Therefore, in these known print devices, an urging means for moving the upper case toward the open position with respect to the lower case is provided. Because of this addition, the upper case generally rotates fairly easily toward the open position.

These known print devices also have a holding means for keeping the upper case in the closed position, when the upper case is closed with respect to the lower case, to overcome the opening movement of the urging means. When an operator rotates the upper case to the closed position, the keeping means retains the upper case in the closed position.

However, when the upper case is in the closed position, and retained by the keeping means, there is a slight separation between the upper case and the lower case at the side having the mounting means. Therefore, if the operator touches the upper case while the printing operation is executed, the upper case moves slightly even though in the closed position. Because the upper case is slightly movable, the light scanning device vibrates with the result that the image formed on the photosensitive body is distorted, that is, there is a problem with the printing quality of the print device caused by the distortion in the image.

SUMMARY OF THE INVENTION

The present invention is developed in an effort to solve the above problem. It is therefore an object of the present invention to provide a print device for enabling an operator to easily move an upper case, mounting a light scanning device, to an open position.

It is a further object of the present invention to provide a print device for keeping the light scanning device still and to provide a good print quality even if the upper case moves slightly while a printing operation is being executed.

To achieve these objects, the print device, for printing a image on a printing medium, by transferring the image formed on a photosensitive member, comprises: an accommodation case which consists of an upper case and a lower case, wherein the upper case can take an opening position and a closing position on the lower case; a light scanning device installed in the accommodation case separately from the upper case and for scanning the photosensitive member with a light; a first urging means for moving the upper case toward the open position with respect to the lower case; keeping means for keeping the upper case in the closed position against the opening force of the first urging means; release means for releasing the keeping means; moving means for moving the light scanning device toward the open position when the upper case is opened; a support member disposed in the lower case for supporting the light scanning device; and second urging means disposed in the upper case for moving the light scanning device toward the support member.

In the print device as described above, the upper case is able to be moved easily to the open position, its movement assisted by the energizing force of the first urging means. However, in this print device, should the operator touch the upper case while a printing operation is being executed so as to slightly move the upper case, the light scanning device does not vibrate because the light scanning device is supported by the lower case.

Therefore, even if the upper case, when closed, is slightly movable, the print quality remains the optimum print level when the upper case is moved.

As described above, the present invention provides in the print device, an upper case that moves easily toward the open position exposing the upper part of the lower case. The present invention further provides a print device which maintains a high printing quality without vibrating the light scanning device even if the upper case is slightly movable when closed and the printing operation is ongoing.

BRIEF DESCRIPTION OF THE DRAWINGS

A preferred embodiment of the present invention will be described in detail with reference to the following figures, in which.

DETAILED DESCRIPTION OF THE REFERRED EMBODIMENT

A preferred embodiment of a laser print device according to the invention will be described with reference to FIGS. 1 through 3.

Figure 1:
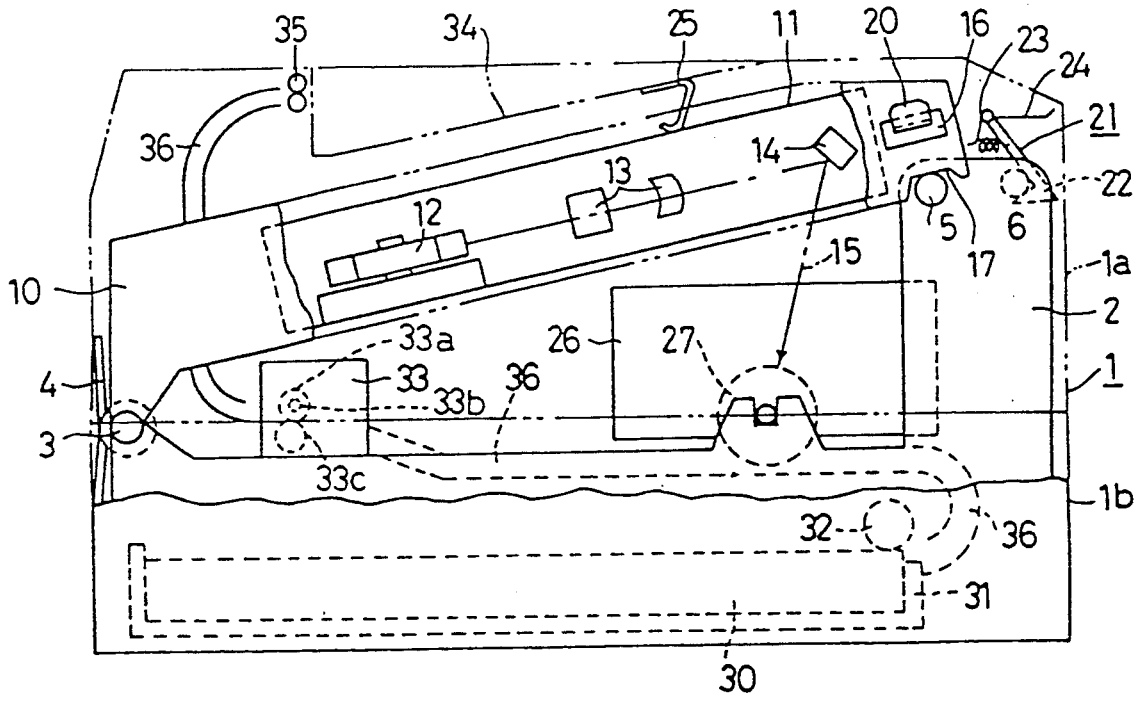
FIG. 1 is a partial sectional side elevation showing the structure of a laser printer.

FIG. 1 is a partial sectional side elevation showing the structure of a laser print device. In FIG. 1, a case 1 is divided in the vicinity of its center into an upper case 1*a* and a lower case 1*b*. A pair of side boards 2 are disposed with a predetermined interval therebetween inside the lower case 1*b* (FIG. 2). A support shaft 3 is mounted between the sideboards 2, on the left end thereof (as viewed in FIGS. 1-3). The upper case 1*a* is supported rotatably on the support shaft 3. The upper case 1*a* rotates between a closed position, where the upper part of the lower case is covered (shown with a solid line in the FIG. 3), and an open position, where the upper part of the lower case is exposed (shown with a two-dot chain line in the FIG. 3), around the support shaft 3. The support shaft 3 is inserted through the coils of a torsion spring 4 so as to support the torsion spring 4. The torsion spring 4 moves the upper case 1*a* toward the open position and corresponds to a first urging member. A supporting pin 5 projects outwardly from the right upper portion of the each of the side boards 2. Each of the supporting pins 5 engages with a bottom portion of an arm portion 10 (described below) so as to support the arm portion 10. Thus, each of the supporting pins 5 may be considered to be a support member.

Each of the arm portions 10 is supported rotatably on an opposite ends of the support shaft 3. A light scanning part 11 is disposed between the arm portions 10. The light scanning part 11 includes a semiconductor laser (not shown), a polygon mirror 12, a lens 13 and a mirror 14. The light scanning part 11 irradiates a light beam 15 (shown with a dashed line in FIG. 1), modulated according to the image data, onto a photosensitive drum 27. The arm portions 10 and the light scanning part 11 together comprise a light scanning device.

Figure 2:
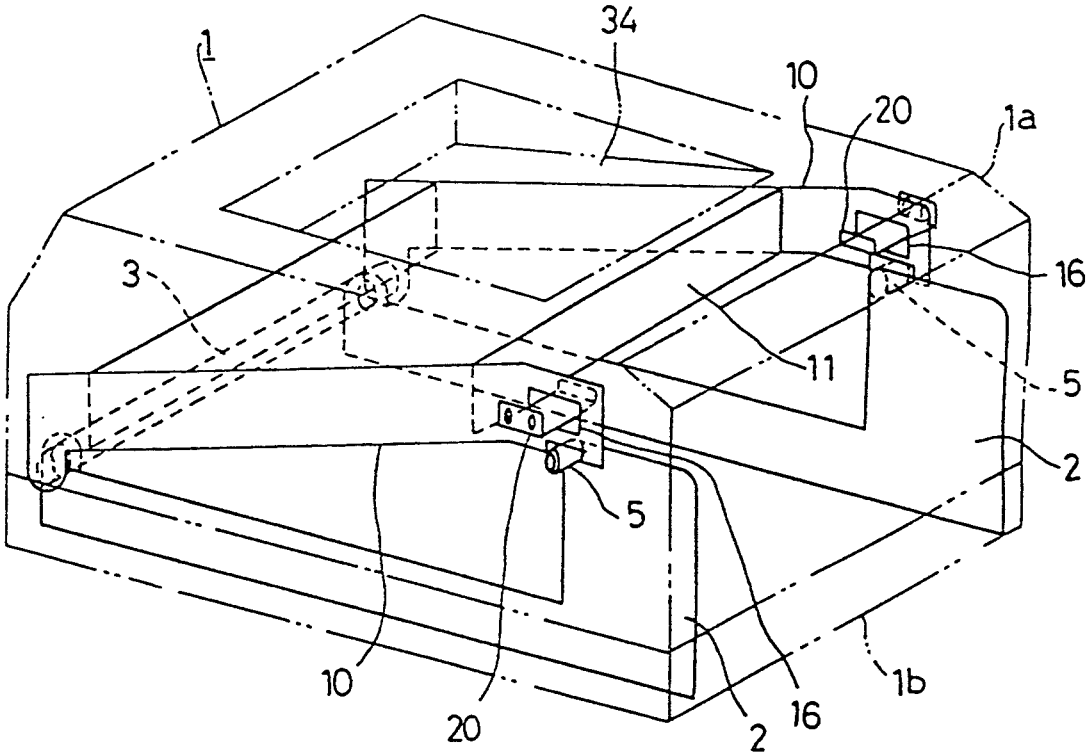
FIG. 2 is a perspective view showing the manner in which a light scanning part is supported.
Figure 3:
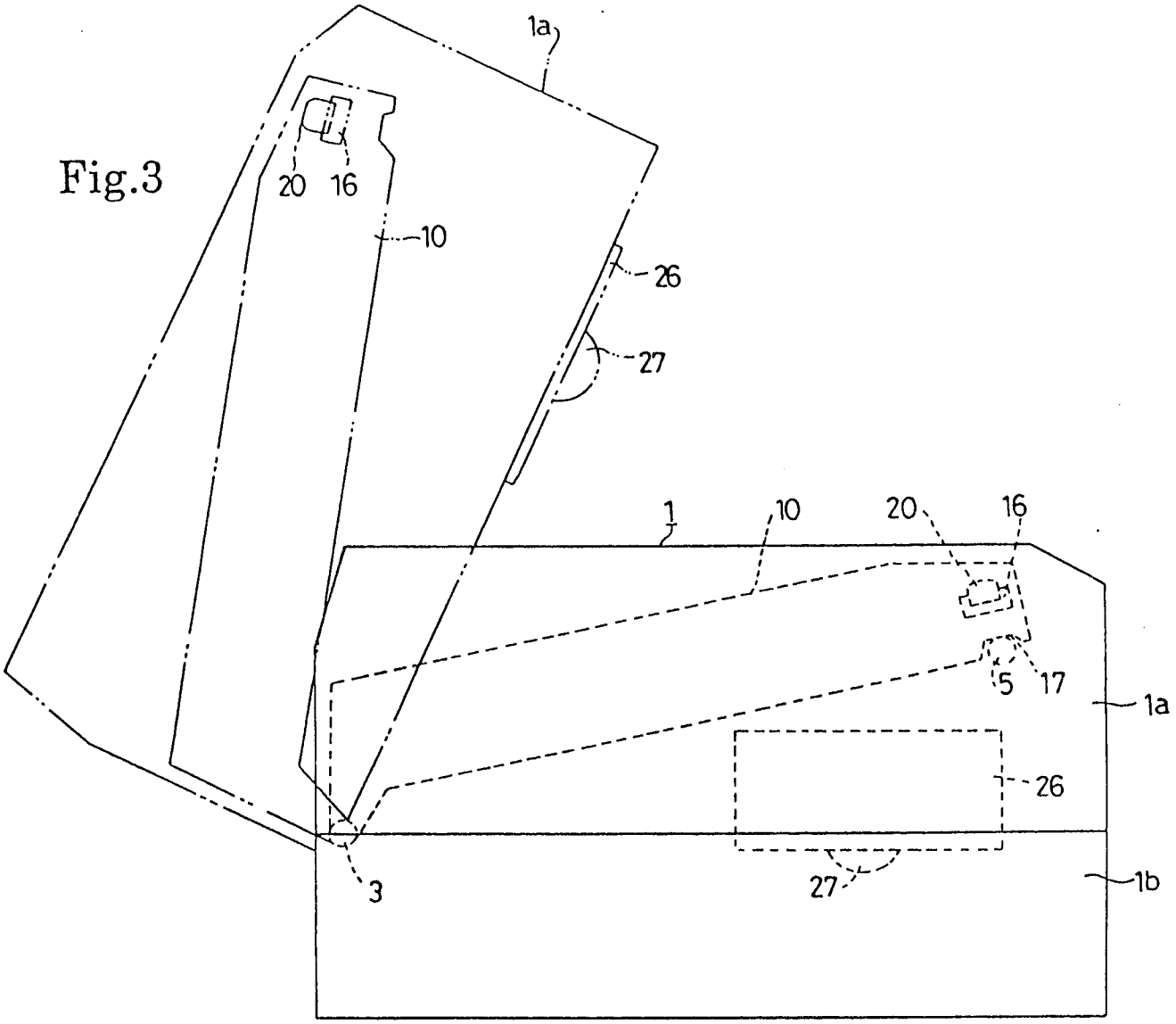
FIG. 3 is a side view showing the rotating operation of the upper case.

An elongated slot 16 is formed near the right end (as shown in FIGS. 1–3) of each of the arm portions 10. On the right lower portion of each of the arm portions 10, substantially below the elongated slot 16, is a notch or indentation 17 to engage with a respective one of the supporting pins 5.

A hook 20, whose cross-section has a U shape with an elongated base, is mounted by one upright to project inward from the inner side of each side of the upper case 1*a*. Each hook 20 is formed so that the innermost upright is inserted through the elongated slot 16 of the arm portion 10 adjacent to that side. Each of the hooks 20 engages the upper part of the elongated slot 16 when the upper case 1*a* rotates so that the hooks 20 cause the arm portions 10 to rotate in the same direction in which the upper case 1*a* rotates.

A lock member 21, for keeping the upper case 1*a* in the closed position, is disposed to the right, as viewed in FIG. 1 of each hook 20. Each lock member 21 consists of a lock part 22 to be engaged with a pin 6 projecting inwardly from the right end of each side board 2, a spring 23 for energizing the lock part 22 so as to engage the lock part 22 with the pin 6, and a lever 24 formed to be rotated with the lock part 22. The lock member 21 and the pin 6 comprise a keeping member.

In addition, a bent spring plate 25 is disposed facing downward from the top or ceiling of the upper case 1*a*. The spring plate 25 forces the notch 17 on the formed lower part of the arm portion 10 against the supporting pin 5 when the upper case 1*a* is closed. The spring plate 25 comprises a second urging member.

A process cartridge 26 is supported detachably in the right lower portion (as shown in FIGS. 1 and 3) of the upper case 1*a*. The process cartridge 26 consists of the photosensitive drum 27, a first electrification device, a developing part, and a cleaning part. The photosensitive drum 27 is supported rotatably by the side boards 2 when the upper case 1*a* is in the closed position (FIG. 1).

A sheet cassette 31, for storing the printing paper 30, is disposed in the lower case 1*b* and a feeding roller 32, for feeding the printing paper 30 from the sheet cassette 31, is rotatably supported above the right (as shown in FIG. 1) upper portion of the sheet cassette 31. The feeding roller 32 comes in contact with the uppermost sheet of printing papers 30 stored in the sheet cassette 31 and delivers the printing paper 30 to the photosensitive drum 27 one sheet after another. A thermal fixing device 33 is disposed above the sheet cassette 31. The thermal fixing device 33 comprises a thermal fixing roller 33*a* having a heater 33*b* therein and a fixing roller 33*c* to apply heat and pressure to the printing paper 30 having an image so that the image is fixed on the printing paper 30.

Above the thermal fixing device 33, in the upper case 1*a*are a pair of exhaust rollers 35 for discharging the printing paper 30, on which the image is fixed, to a sheet tray 34 formed on the upper, outer surface of the upper case 1*a*.

A sheet feeding passage 36 is formed between each of the elements, such as the sheet cassette 31, the photosensitive drum 27, the thermal fixing device 33 and the exhaust rollers 35. Therefore, when the upper case 1*a* rotates to the open position, a part of the sheet feeding passage 36 is exposed and the printing paper 30 stoppages in the sheet feeding passage 36 can be removed.

The laser printer, having the above mentioned structure operates as will now be explained.

Usually, the upper case 1*a* is kept in the closed position, against the opening force of the torsion spring 4, by the lock member 21. When the upper case 1*a* is closed, the spring plate 25 engages the upper part of the light scanning part 11 and the notch 17, formed on each of the arm portions 10, is pressed against the supporting pin 5 respectively by the force exerted by the spring plate 25. Because of this, the light scanning part 11 is firmly seated on both of the side boards 2.

Therefore, even if an operator applies a downward pressure to the upper case 1*a*, so that the upper case is moved slightly, the light scanning part 11 does not move or vibrate. Because the scanning part 11 comes in contact with the upper case 1*a* only through the spring plate 25, which is resilient, the light scanning part 11 is not influenced by the movement of the upper case 1*a*.

In the above mentioned construction, when an image data is input by the way of the external device, the light beam, modulated according to the image data, is irradiated from the light scanning part 11 onto the photosensitive drum 27 so that an electrostatic latent image is formed on the photosensitive drum 27. The uppermost sheet of the printing papers 30, stored in the sheet cassette 31, is delivered to the photosensitive drum 27 by the feeding roller 32 where the electrostatic latent image is transcribed to the printing paper and the image is then fixed on the printing paper 30 by the thermal fixing device 33. The printing paper 30 on which the image is fixed is discharged by the exhaust roller 35 to the sheet tray 34.

In this printing portion process, when the printing paper 30 stops in the sheet feeding passage 36 because of a paper jam or when the operator wants to repair or maintain the elements of the upper case 1*a*, such as the process cartridge, the operator rotates the lever 24 counterclockwise (as seen in FIG. 1). With the rotation of the lever 24, the lock part 22 rotates counterclockwise so that the lock part 22 is removed from the pin 6. This permits the torsion spring 4 to exert its opening force and the upper case 1*a* rotates to the open position (shown in FIG. 3) about the support shaft 3. With the rotation of the upper case 1*a*, the hooks 20 come in contact with and engage the upper part of the elongated slot 16 formed on each of the arm portions 10 so that the arm portions 10 are rotated in the same direction as the upper case 1*a*. As a result, the upper part of the lower case 1*b* and a part of the sheet feeding passage 36 are exposed and the operator can remove easily the jammed printing paper 30 or perform the desired maintenance or repairs.

After the operator removes the jammed printing paper 30, or completes the repairs or maintenance of the elements of the upper case 1*a*such as the process cartridge, the operator closes the upper case 1*a* by rotating it to a position which exceeds the closed and latched position. This permits the lock part 22 to engage the pin 6 so that the upper case 1*a* is kept in the closed position. Moreover, in accordance with the rotation of the upper case 1*a*, the arm portions 10 rotate so that the notch parts 17 engage with the supporting pins 5.

In the laser printer, as described above, when the upper case 1*a* is kept in the closed position, the light scanning part 11 is supported by the supporting pins 5 of the arm portions 10. In this position, even though the upper case 1*a* is slightly movable, the light scanning part 11 does not vibrate because the light scanning part 11 is in contact with the upper case 1*a* only through the resilient spring plate 25. Moreover, the light scanning part 11 does not get out of the position from where the light scanning part 11 ought to be positioned because the arm portions 10 are pressed to the supporting pins 5 by the force of the spring plate 25. Therefore, even if the operator puts a weight on, or pushes downwardly on, the upper case 1*a* so that the upper case 1*a* moves slightly, the light scanning part does not move or vibrate. Because of this, the printing quality is kept maintained at a high quality.

Further, since the light scanning part 11 and the photosensitive drum 27 are supported by the side boards 2, they are able to be positioned accurately.

Also as the upper case 1*a* is pressed to the opening direction by the force of the torsion spring 4, the operator can easily rotate the upper case 1*a* to the open position. As the upper case 1*a* rotates to the open position, the light scanning part 11 and the process cartridge 26 rotate in the same direction. Therefore, the upper part of the lower case 1*b* and a part of the sheet feeding passage 36 are exposed so that the operator can remove easily jammed printing paper 30 and make repairs or conduct maintenance easily on the elements mounted in the lower case 1*b*.

As described above, the present invention provides a print device that enables the operator to easily rotate the upper case to the open position and a print device for maintaining a good printing quality free of the defects produced by moving, or vibrating, the light scanning device even if the upper case is moved slightly while the printing operation is being executed.

What is claimed is:

1. A print device, for printing a image on a printing medium by transferring the image formed on a photosensitive member to the printing medium, comprising:

an accommodation case further comprising an upper case and a lower case, the upper case rotatable between an open position and a closed position with respect to the lower case;

a light scanning device rotatably mounted in the accommodation case separately from the upper case and for scanning the photosensitive member with a light;

a moving means for moving the light scanning device toward the open position when the upper case is opened;

a support member disposed in the lower case for supporting the light scanning device when the upper case is closed;

a first urging means mounted in the upper case for urging the light scanning device toward the support member;

a second urging means for applying a force to move the upper case toward the open position;

a keeping means for holding the upper case in the closed position against the force of the second urging means; and a release means for releasing the keeping means.

2. A printing device, comprising:

a printer body having an upper case and a lower case;

a shaft located along one end of said printer body between said upper and lower cases, said shaft having said upper case rotatably attached thereto;

a pair of side boards mounted on opposing sides of said lower case, said shaft mounted between said pair of side boards;

a pair of arm portions rotatably mounted on opposing sides of said upper case, said pair of arm portions rotatable about said shaft;

a light scanning part mounted between said pair of arm portions;

a process cartridge removably mounted in said upper case;

retention means for holding said upper case in a closed position; and stabilization means for maintaining said light scanning part and said process cartridge in a stable relationship during image formation.

3. A printing device as claimed in claim 2, further comprising:

a torsion spring mounted on said shaft for urging said upper case toward an open position.

4. A printer device as claimed in claim 3, further comprising:

a lifting means for rotating said pair of arm portions with said upper case; and a spring member mounted to a ceiling of said upper case for urging said light scanning part in a direction opposite to an opening rotation.

5. A printer device as claimed in claim 4, wherein each side board of said pair of side boards has an upward extension at an end away from said shaft, said stabilization means comprises a first pin projecting outwardly from a toe of said upward extension of each said side board; and a notch on a lower surface of each arm portion of said pair of arm portions at a position near an end of said arm portion away from said shaft, said notch of said arm portion engaging said first pin of a corresponding said side board when said upper case is in a closed position.

6. A print device as claimed in claim 5, wherein said process cartridge contains:

a photosensitive drum having bearings extending to each side of said process cartridge along an axis of rotation of said photosensitive drum.

7. A printer device as claimed in claim 6, wherein said stabilization means further comprises a support member on an upper surface of each said side board between said shaft and said upward extension, said support member rotatably supporting a respective one of said bearings of said photosensitive drum.

8. A printer device as claimed in claim 5, wherein said retention means comprises a second pin projecting inwardly from said toe of each said side board; and a pair of substantially hook-shaped locked parts, one locked part pivotally mounted to an inside of each side wall of said upper case, a projection of said locked part engaging said second pin of an associated side board;

a lever attached between said pair of locked parts for disengaging said projections from said second pins; and a spring attached between said side wall of said upper case and said locked part for engaging said projection on said second pin.

9. A printer device as claimed in claim 5, wherein said retention means comprises a second pin projecting inwardly from said toe of one of said side boards; and a substantially hook-shaped locked part, said located part pivotally mounted to an inside of a side wall of said upper case corresponding to said one of said side boards, a projection of said locked part engaging said second pin of said one of said side boards;

a lever attached to said locked part for disengaging said projection from said second pin; and a spring attached between said side wall of said upper case and said locked part for engaging said projection on said second pin.

10. A printer device as claimed in claim 4, wherein said lifting means comprises: an elongated opening in an end of each arm portion of said pair of arm portions away from said shaft; and a hook extending from each side wall of said upper case, said hook passing through said elongated opening in said arm portion adjacent said side wall.

11. A printer device as claimed in claim 4, wherein each said side board is substantially L-shaped.

12. A printer device as claimed in claim 11, wherein a foot of each said L-shaped side board is located at an end away from said shaft; and said stabilization means comprises a first pin projecting inwardly from a toe of said foot of each said L-shaped side board; and a notch on a lower surface of each arm portion of said pair of arm portions at a position near an end of said arm portion away from said shaft, said notch of said arm portion engaging a first pin of a corresponding said L-shaped side board when said upper case is in a closed position.

13. A print device as claimed in claim 12, wherein said process cartridge contains:

a photosensitive drum having bearings extending to each side of said process cartridge along an axis of rotation of said photosensitive drum.

14. A printer device as claimed in claim 13, wherein said stabilization means further comprises a support member on an upper surface of a leg of each said L-shaped side board, said support member rotatably supporting said photosensitive drum.

15. A printer device as claimed in claim 14, wherein said retention means comprises a second pin projecting inwardly from said toe of each said L-shaped side board; and a pair of substantially hook-shaped locked parts, one locked part pivotally mounted to an inside of each side wall of said upper case, a projection of said locked part engaging said second pin of an associated L-shaped side board;

a lever attached between said pair of locked parts for disengaging said projections from said second pins; and a spring attached between said side wall of said upper case and said locked part for engaging said projection on said second pin.

16. A printer device as claimed in claim 15, wherein said lifting means comprises an elongated opening in an end of each arm position of said pair of arm portions away from said shaft; and a hook extending from each side wall of said upper case, said hook passing through said elongated opening in said arm portion adjacent said side wall.

17. A printer device as claimed in claim 14, wherein said retention means comprises a second pin projecting inwardly from said toe of one of said L-shaped side boards; and a substantially hook-shaped locked part, said locked part pivotally mounted to an inside of a side wall of said upper case corresponding to said one of said L-shaped side boards, a projection of said locked part engaging said second pin of said one of said L-shaped side boards;

a level attached to said locked part for disengaging said projection from said second pin; and a spring attached between said side wall of said upper case and said locked part for engaging said projection on said second pin.

* * * * *